US007367317B2

(12) United States Patent
Miyazaki et al.

(10) Patent No.: US 7,367,317 B2
(45) Date of Patent: May 6, 2008

(54) CONTROL APPARATUS FOR INTERNAL COMBUSTION ENGINE

(75) Inventors: Kazuma Miyazaki, Toyota (JP); Takashi Watanabe, Susono (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 11/335,506

(22) Filed: Jan. 20, 2006

(65) Prior Publication Data

US 2006/0207556 A1 Sep. 21, 2006

(30) Foreign Application Priority Data

Mar. 18, 2005 (JP) ..... 2005-078310

(51) Int. Cl.
*F02B 7/04* (2006.01)

(52) U.S. Cl. ..... 123/431; 123/299; 123/491

(58) Field of Classification Search ..... 123/299, 123/300, 431, 491, 685, 686
See application file for complete search history.

(56) References Cited

U.S. PATENT DOCUMENTS 5,482,023 A 1/1996 Hunt et al.
6,371,094 B1 * 4/2002 Wagner ..... 123/576
6,959,693 B2 * 11/2005 Oda ..... 123/431

FOREIGN PATENT DOCUMENTS

| | | |
|---|---|---|
| EP | 1 500 807 A2 | 1/2005 |
| JP | A 61-250354 | 11/1986 |
| JP | A 10-18884 | 1/1998 |
| JP | A 10-176562 | 6/1998 |
| JP | A 2000-186597 | 7/2000 |
| JP | A 2001-73854 | 3/2001 |
| JP | A 2003-20975 | 1/2003 |
| WO | WO 2006/008904 A1 | 1/2006 |

* cited by examiner

*Primary Examiner*—Erick Solis
(74) *Attorney, Agent, or Firm*—Oliff & Berridge, PLC

(57) ABSTRACT

An engine ECU executes a program including a step of sensing a coolant temperature TW of an engine, if a start request of the engine is sensed, a step of causing only an intake manifold injector to inject fuel to start engine 10, if coolant temperature TW is lower than a threshold value TW(0), and a step of causing only an in-cylinder injector to inject fuel to start engine 10, if coolant temperature TW is higher than threshold value TW(0).

8 Claims, 4 Drawing Sheets

CONTROL APPARATUS FOR INTERNAL COMBUSTION ENGINE

This nonprovisional application is based on Japanese Patent Application No. 2005-078310 filed with the Japan Patent Office on Mar. 18, 2005, the entire contents of which are hereby incorporated by reference.

BACKGROUND OF THE INVENTION

1. Field of the Invention

The present invention relates to a control apparatus for an internal combustion engine having a first fuel injection mechanism (an in-cylinder injector) injecting fuel into a cylinder and a second fuel injection mechanism (an intake manifold injector) injecting the fuel into an intake manifold or an intake port, and relates particularly to a technique for starting the internal combustion engine.

2. Description of the Background Art

An internal combustion engine having an intake manifold injector for injecting fuel into an intake manifold of the engine and an in-cylinder injector for injecting the fuel into a combustion chamber of the engine is known. When starting such an internal combustion engine, the fuel is injected into the intake manifold.

Japanese Patent Laying-Open No. 2001-073854 discloses a fuel injection control apparatus for an internal combustion engine of in-cylinder injection type that has a main fuel injection valve injecting fuel directly into a combustion chamber and an auxiliary fuel injection valve injecting the fuel into an intake manifold, and that is capable of reducing emission of uncombusted components in starting the engine to suppress undue fuel consumption. The fuel injection control apparatus according to Japanese Patent Laying-Open No. 2001-073854 includes: an auxiliary fuel injection valve controller causing the auxiliary fuel injection valve to start injecting fuel when the engine is started; and a main fuel injection valve controller prohibiting the main fuel injection valve from injecting the fuel for a period from a time point where the engine is started until a time point where the concentration of an air-fuel mixture formed in the combustion chamber by the fuel injected from the auxiliary fuel injection valve reaches at least a prescribed value, and allowing the main fuel injection valve to start injecting the fuel when the period has elapsed.

According to the fuel injection control apparatus, when the engine is started, the concentration of the air-fuel mixture formed in the combustion chamber by the fuel injected from the auxiliary fuel injection valve is awaited to be at least a prescribed value, and then the main fuel injection valve is allowed to start injecting the fuel. Therefore, a period from a time point where the main fuel injection valve starts injecting the fuel until a time point of initial combustion is shortened, or the main fuel injection valve starts injecting the fuel after initial combustion. This minimizes such an event that vaporization of the fuel injected from the main fuel injection valve is not facilitated and the fuel is accumulated in the combustion chamber in the liquid state, when starting the engine where the temperature thereof is low. Thus, emission of uncombusted components in starting the engine can be reduced and undue fuel consumption is suppressed.

However, according to the fuel injection control apparatus disclosed in Japanese Patent Laying-Open No. 2001-073854, the internal combustion engine is started while fuel is injected into the intake manifold to facilitate vaporization. Accordingly, if the temperature of the internal combustion engine is fully high, for example, vaporization may be unduly facilitated. In such a case, the air-fuel mixture is excessively high in ignitionability, which may lead to its self-ignition before being ignited by the spark plug (hereinafter also referred to as preignition) or to knocking. Accordingly, there has been a problem in establishing compatibility between prevention of preignition/knocking and prevention of occurrence of uncombusted fuel.

SUMMARY OF THE INVENTION

An object of the present invention is to provide a control apparatus for an internal combustion engine that can establish compatibility between prevention of preignition/knocking and prevention of occurrence of uncombusted fuel.

A control apparatus for an internal combustion engine according to the present invention controls an internal combustion engine having a first fuel injection mechanism injecting fuel into a cylinder and a second fuel injection mechanism injecting the fuel into an intake manifold. The control apparatus includes: a first controller controlling the internal combustion engine in a warm state so that only the first fuel injection mechanism injects the fuel to start the internal combustion engine; and a second controller controlling the internal combustion engine in a cold state so that only the second fuel injection mechanism injects the fuel to start the internal combustion engine.

According to the present invention, the fuel readily vaporizes and therefore uncombusted fuel is less likely to remain in the cylinder when starting the engine in the warm state. However, since the temperature inside the cylinder is high and thus preignition and/or knocking are likely to occur, only the first fuel injection mechanism injects fuel directly into the cylinder. Thus, the temperature inside the cylinder is decreased, and the engine can be started while preventing preignition and/or knocking. Preignition and/or knocking are less likely to occur when starting the engine in the cold state as the temperature inside the cylinder is low. However, since the fuel does not vaporize readily and thus uncombusted fuel is likely to present, only the second fuel injection mechanism injects the fuel into the intake manifold. This can facilitate vaporization of the fuel and prevent uncombusted fuel. As a result, a control apparatus for an internal combustion engine that can establish compatibility between prevention of preignition/knocking and prevention of occurrence of uncombusted fuel can be provided.

Preferably, the first fuel injection mechanism is an in-cylinder injector. The second fuel injection mechanism is an intake manifold injector.

According to the present invention, in an internal combustion engine in which an in-cylinder injector that is the first fuel injection mechanism and an intake manifold injector that is the second fuel injection mechanism are separately provided to bear shares, respectively, of injecting fuel, compatibility between prevention of preignition/knocking and prevention of occurrence of uncombusted fuel can be established.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
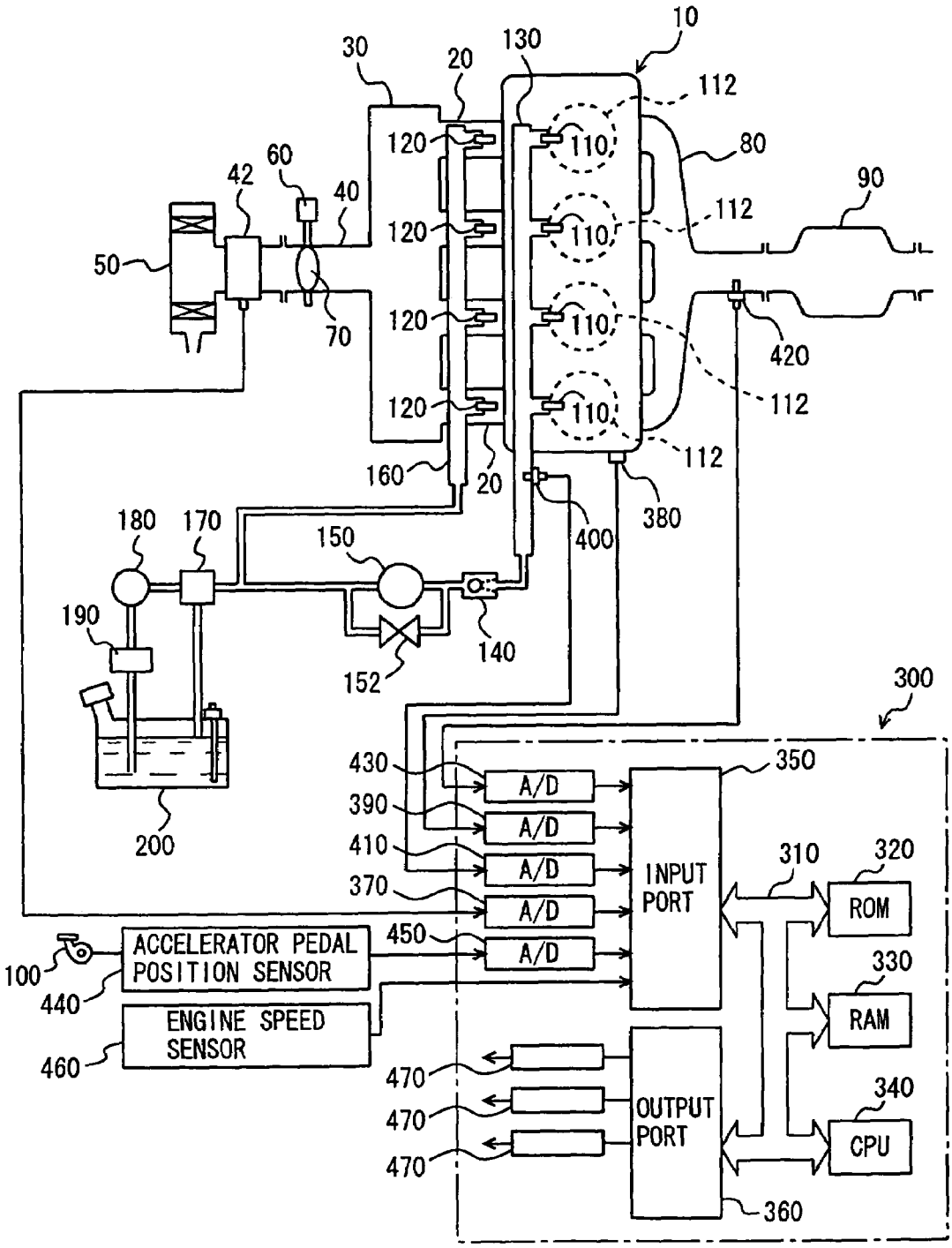
FIG. 1 is a schematic configuration diagram of an engine system controlled by a control apparatus according to an embodiment of the present invention.

Hereinafter, an embodiment of the present invention will be described with reference to the drawings. In the following description, the same parts have the same reference characters allotted and also have the same names and functions. Thus, detailed description thereof will not be repeated.

FIG. 1 is a schematic configuration diagram of an engine system that is controlled by an engine ECU (Electronic Control Unit) implementing the control apparatus for an internal combustion engine according to an embodiment of the present invention. In FIG. 1, an in-line 4-cylinder gasoline engine is shown, although the application of the present invention is not restricted to such an engine and it may be applied to various types of engines such as a V6-cylinder engine, a V8-cylinder engine and the like.

As shown in FIG. 1, engine 10 includes four cylinders 112, each connected via a corresponding intake manifold 20 to a common surge tank 30. Surge tank 30 is connected via an intake duct 40 to an air cleaner 50. An airflow meter 42 is arranged in intake duct 40, and a throttle valve 70 driven by an electric motor 60 is also arranged in intake duct 40. Throttle valve 70 has its degree of opening controlled based on an output signal of an engine ECU (Electronic Control Unit) 300, independently from an accelerator pedal 100. Each cylinder 112 is connected to a common exhaust manifold 80, which is connected to a three-way catalytic converter 90.

Each cylinder 112 is provided with an in-cylinder injector 110 for injecting fuel into the cylinder and an intake manifold injector 120 for injecting fuel into an intake port or/and an intake manifold. Injectors 110 and 120 are controlled based on output signals from engine ECU 300. Further, in-cylinder injector 110 of each cylinder is connected to a common fuel delivery pipe 130. Fuel delivery pipe 130 is connected to a high-pressure fuel pump 150 of an engine-driven type, via a check valve 140 that allows a flow in the direction toward fuel delivery pipe 130. In the present embodiment, an internal combustion engine having two injectors separately provided is explained, although the present invention is not restricted to such an internal combustion engine. For example, the internal combustion engine may have one injector that can effect both in-cylinder injection and intake manifold injection.

As shown in FIG. 1, the discharge side of high-pressure fuel pump 150 is connected via an electromagnetic spill valve 152 to the intake side of high-pressure fuel pump 150. As the degree of opening of electromagnetic spill valve 152 is smaller, the quantity of the fuel supplied from high-pressure fuel pump 150 into fuel delivery pipe 130 increases. When electromagnetic spill valve 152 is fully open, the fuel supply from high-pressure fuel pump 150 to fuel delivery pipe 130 is stopped. Electromagnetic spill valve 152 is controlled based on an output signal of engine ECU 300.

Each intake manifold injector 120 is connected to a common fuel delivery pipe 160 on a low pressure side. Fuel delivery pipe 160 and high-pressure fuel pump 150 are connected via a common fuel pressure regulator 170 to a low-pressure fuel pump 180 of an electric motor-driven type. Further, low-pressure fuel pump 180 is connected via a fuel filter 190 to a fuel tank 200. Fuel pressure regulator 170 is configured to return a part of the fuel discharged from low-pressure fuel pump 180 back to fuel tank 200 when the pressure of the fuel discharged from low-pressure fuel pump 180 is higher than a preset fuel pressure. This prevents both the pressure of the fuel supplied to intake manifold injector 120 and the pressure of the fuel supplied to high-pressure fuel pump 150 from becoming higher than the above-described preset fuel pressure.

Engine ECU 300 is implemented with a digital computer, and includes a ROM (Read Only Memory) 320, a RAM (Random Access Memory) 330, a CPU (Central Processing Unit) 340, an input port 350, and an output port 360, which are connected to each other via a bidirectional bus 310.

Airflow meter 42 generates an output voltage that is proportional to an intake air quantity, and the output voltage is input via an A/D converter 370 to input port 350. A coolant temperature sensor 380 is attached to engine 10, and generates an output voltage proportional to a coolant temperature of the engine, which is input via an A/D converter 390 to input port 350.

A fuel pressure sensor 400 is attached to fuel delivery pipe 130, and generates an output voltage proportional to a fuel pressure within fuel delivery pipe 130, which is input via an A/D converter 410 to input port 350. An air-fuel ratio sensor 420 is attached to an exhaust manifold 80 located upstream of three-way catalytic converter 90. Air-fuel ratio sensor 420 generates an output voltage proportional to an oxygen concentration within the exhaust gas, which is input via an A/D converter 430 to input port 350.

Air-fuel ratio sensor 420 of the engine system of the present embodiment is a full-range air-fuel ratio sensor (linear air-fuel ratio sensor) that generates an output voltage proportional to the air-fuel ratio of the air-fuel mixture burned in engine 10. As air-fuel ratio sensor 420, an $O_2$ sensor may be employed, which detects, in an on/off manner, whether the air-fuel ratio of the air-fuel mixture burned in engine 10 is rich or lean with respect to a stoichiometric air-fuel ratio.

Accelerator pedal 100 is connected with an accelerator pedal position sensor 440 that generates an output voltage proportional to the degree of press down of accelerator pedal 100, which is input via an A/D converter 450 to input port 350. Further, an engine speed sensor 460 generating an output pulse representing the engine speed is connected to input port 350. ROM 320 of engine ECU 300 prestores, in the form of a map, values of fuel injection quantity that are set in association with operation states based on the engine load factor and the engine speed obtained by the above-described accelerator pedal position sensor 440 and engine speed sensor 460, and correction values thereof set based on the engine coolant temperature.

Figure 2:
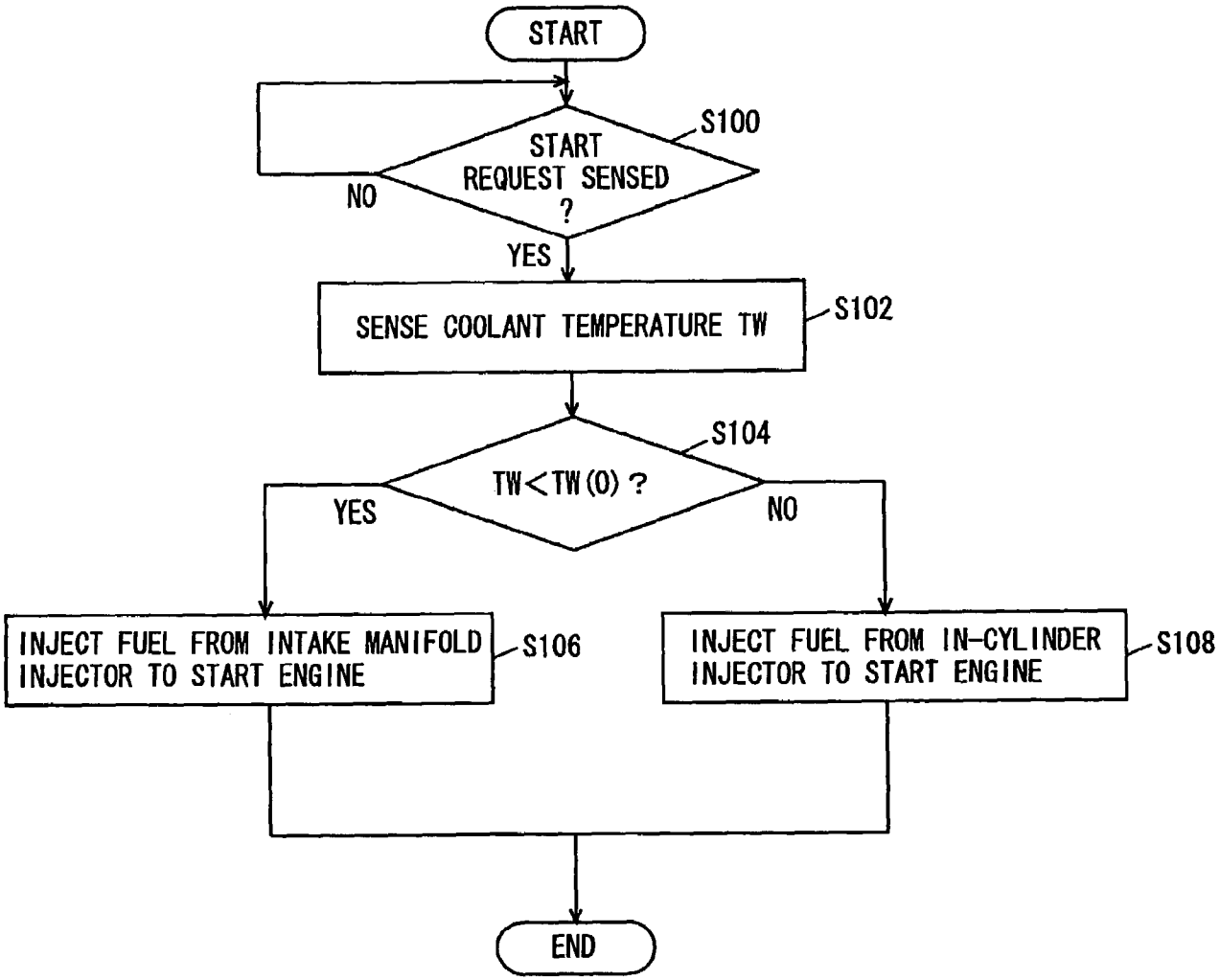
FIG. 2 is a flowchart of a program executed by an engine ECU.

Referring to FIG. 2, a control structure of a program executed by an engine ECU 300 implementing a control apparatus according to the present embodiment will be described.

In step (hereinafter step is abbreviated as S) 100, engine ECU 300 determines whether a request for starting engine 10 (hereinafter referred to as a start request of engine 10) is sensed. For example, when the start switch is turned on, or when the ignition key is operated to reach a starting position, it is determined that a start request of engine 10 is sensed. When the start request is sensed (YES in S100), the process goes to S102. Otherwise (NO in S100) the process goes back to S100.

In S102, engine ECU 300 senses a coolant temperature TW of engine 10 from a signal transmitted from coolant temperature sensor 380. In S104, engine ECU 300 determines whether coolant temperature TW is lower than a threshold value TW(0). If coolant temperature TW is lower than threshold value TW(0) (YES in S104), the process goes to S106. Otherwise (NO in S104), the process goes to S108.

In S106, engine ECU 300 causes only intake manifold injector 120 to inject fuel to start engine 10. Thereafter, this process ends. In S108, engine ECU 300 causes only in-cylinder injector 110 to inject fuel to start engine 10. Thereafter, this process ends.

An operation of engine 10 controlled by engine ECU 300 implementing the control apparatus according to the present embodiment based on the above-described structure and flowchart will be described.

In a state where engine 10 is stopped, when a start request is sensed (YES in S100), coolant temperature TW of engine 10 is sensed from a signal transmitted from coolant temperature sensor 380 (S102).

When engine 10 is started in a cold state, preignition or knocking is less likely to occur as the temperature inside the cylinder is low. However, uncombusted fuel is likely to remain as the injected fuel does not readily vaporize. Accordingly, when coolant temperature TW is lower than threshold value TW(0) (YES in S104), that is, in a cold state of engine 10, solely intake manifold injector 120 is caused to inject fuel to start engine 10 (S106).

As compared to the case where fuel is directly injected into the cylinder, the fuel injected from intake manifold cylinder 120 to an intake port and/or intake manifold is facilitated to vaporize. Thus, a homogeneous air-fuel mixture can be supplied inside the cylinder to start engine 10. Accordingly, it is possible to prevent occurrence of uncombusted fuel in starting engine 10.

On the other hand, when engine 10 is started in a warm state, uncombusted fuel is less likely to remain as the injected fuel readily vaporizes. However, preignition or knocking is likely to occur as the temperature inside the cylinder is high. Accordingly, when coolant temperature TW is higher than threshold value TW(0) (NO in S104), that is, in a warm state of engine 10, solely in-cylinder injector 110 is caused to inject fuel to start engine 10 (S108).

By the fuel injected into the cylinder from in-cylinder injector 110, the temperature inside the cylinder decreases. Thus, preignition or knocking can be prevented in starting engine 10.

In the above-described manner, in the vehicle incorporating the engine ECU according to the present embodiment, fuel is injected from the intake manifold injector to the intake port and/or intake manifold when starting the engine in a cold state. Thus, a homogeneous air-fuel mixture can be supplied to prevent occurrence of uncombusted fuel. Additionally, fuel is injected from the in-cylinder injector into the cylinder when starting the engine in a warm state. Thus, the temperature inside the cylinder decreases by the fuel injected into the cylinder to prevent preignition or knocking. As a result, compatibility between prevention of preignition/knocking and prevention of occurrence of uncombusted fuel can be established.

Engine (1) to Which Present Control Apparatus is Suitably Applied

An engine (1) to which the control apparatus of the present embodiment is suitably applied will now be described.

Figure 3:
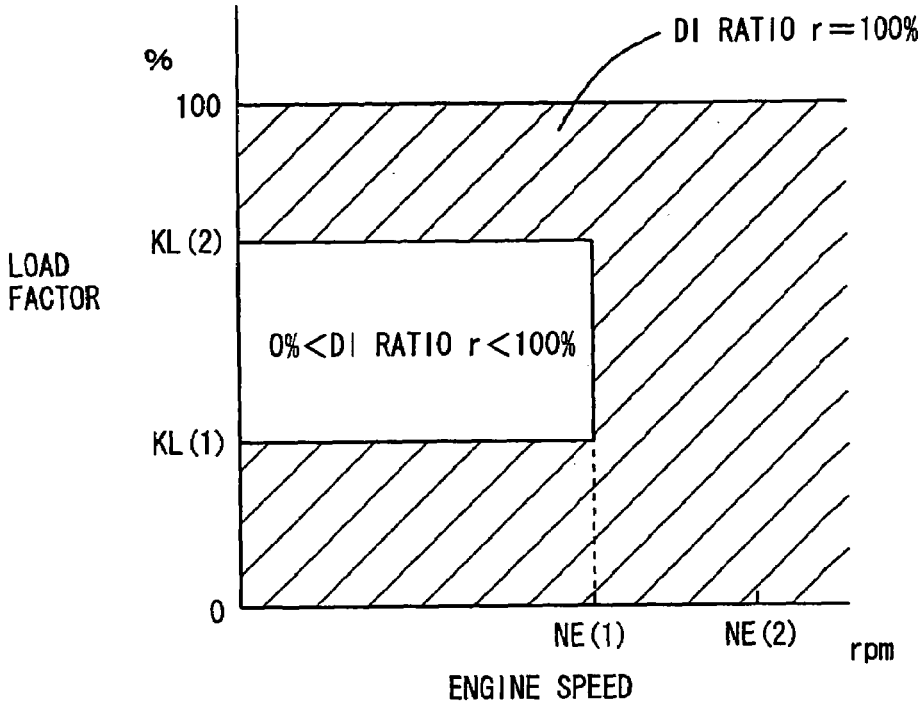
FIG. 3 shows a DI ratio map for a warm state (1) of an engine to which the present control apparatus is suitably applied.
Figure 4:
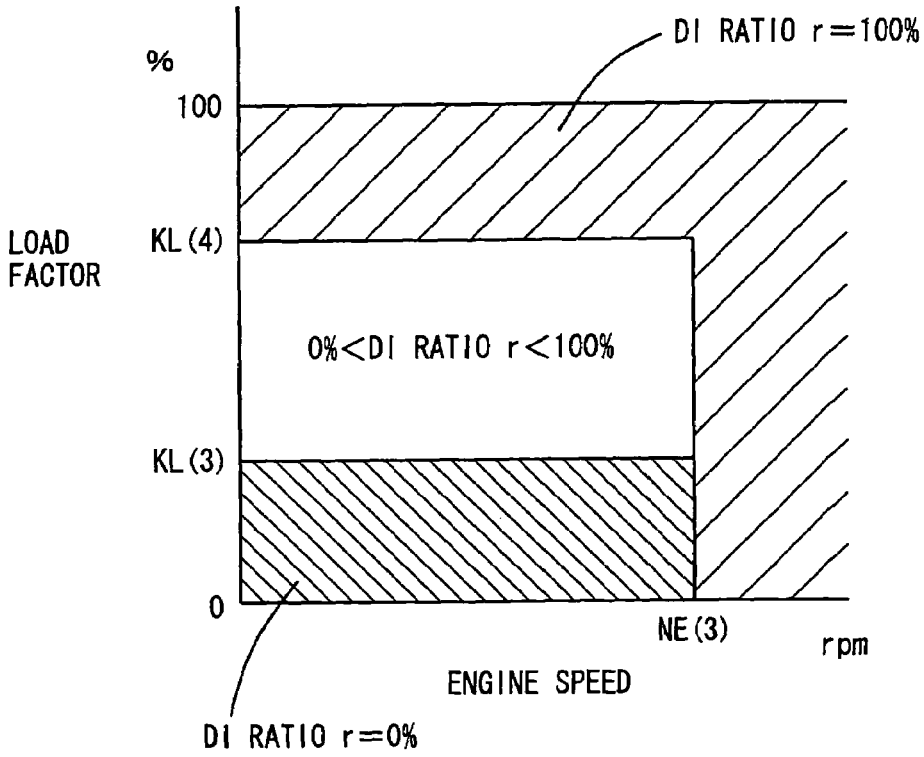
FIG. 4 shows a DI ratio map for a cold state (1) of an engine to which the present control apparatus is suitably applied.

Referring to FIGS. 3 and 4, maps each indicating a fuel injection ratio between in-cylinder injector 10 and intake manifold injector 120, identified as information associated with an operation state of engine 10, will now be described. Herein, the fuel injection ratio between the two injectors is also expressed as a ratio of the quantity of the fuel injected from in-cylinder injector 110 to the total quantity of the fuel injected, which is referred to as the "fuel injection ratio of in-cylinder injector 110", or a "DI (Direct Injection) ratio (r)". The maps are stored in ROM 320 of engine ECU 300. FIG. 3 is the map for a warm state of engine 10, and FIG. 4 is the map for a cold state of engine 10.

In the maps illustrated in FIGS. 3 and 4, with the horizontal axis representing an engine speed of engine 10 and the vertical axis representing a load factor, the fuel injection ratio of in-cylinder injector 110, or the DI ratio r, is expressed in percentage.

As shown in FIGS. 3 and 4, the DI ratio r is set for each operation range that is determined by the engine speed and the load factor of engine 10. "DI RATIO r=100%" represents the range where fuel injection is carried out using only in-cylinder injector 110, and "DI RATIO r=0%" represents the range where fuel injection is carried out using only intake manifold injector 120. "DI RATIO r≠0%", "DI RATIO r≠100%" and "0%<DI RATIO r<100%" each represent the range where fuel injection is carried out using both in-cylinder injector 110 and intake manifold injector 120. Generally, in-cylinder injector 110 contributes to an increase of output performance, while intake manifold injector 120 contributes to uniformity of the air-fuel mixture. These two kinds of injectors having different characteristics are appropriately selected depending on the engine speed and the load factor of engine 10, so that only homogeneous combustion is conducted in the normal operation state of the engine (other than the abnormal operation state such as a catalyst warm-up state during idling).

Further, as shown in FIGS. 3 and 4, the fuel injection ratio between in-cylinder injector 110 and intake manifold injector 120, or, the DI ratio r, is defined individually in the map for the warm state and in the map for the cold state of the engine. The maps are configured to indicate different control ranges of in-cylinder injector 110 and intake manifold injector 120 as the temperature of engine 10 changes. When the temperature of engine 10 detected is equal to or higher than a predetermined temperature threshold value, the map for the warm state shown in FIG. 3 is selected; otherwise, the map for the cold state shown in FIG. 4 is selected. One or both of in-cylinder injector 110 and intake manifold injector 120 are controlled based on the selected map and according to the engine speed and the load factor of engine 10.

The engine speed and the load factor of engine 10 set in FIGS. 3 and 4 will now be described. In FIG. 3, NE(1) is set to 2500 rpm to 2700 rpm, KL(1) is set to 30% to 50%, and KL(2) is set to 60% to 90%. In FIG. 4, NE(3) is set to 2900 rpm to 3100 rpm. That is, NE(1)<NE(3). NE(2) in FIG. 3 as well as KL(3) and KL(4) in FIG. 4 are also set as appropriate.

When comparing FIG. 3 and FIG. 4, NE(3) of the map for the cold state shown in FIG. 4 is greater than NE(1) of the map for the warm state shown in FIG. 3. This shows that, as the temperature of engine 10 is lower, the control range of intake manifold injector 120 is expanded to include the range of higher engine speed. That is, in the case where engine 10 is cold, deposits are unlikely to accumulate in the injection hole of in-cylinder injector 110 (even if the fuel is not injected from in-cylinder injector 110). Thus, the range where the fuel injection is to be carried out using intake manifold injector 120 can be expanded, to thereby improve homogeneity.

When comparing FIG. 3 and FIG. 4, "DI RATIO r=100%" in the range where the engine speed of engine 10 is NE(1) or higher in the map for the warm state, and in the range where the engine speed is NE(3) or higher in the map for the cold state. In terms of load factor, "DI RATIO r=100%" in the range where the load factor is KL(2) or greater in the map for the warm state, and in the range where the load factor is KL(4) or greater in the map for the cold state. This means that in-cylinder injector 110 solely is used in the range of a predetermined high engine speed, and in the range of a predetermined high engine load. That is, in the high speed range or the high load range, even if fuel injection is carried out using only in-cylinder injector 110, the engine speed and the load of engine 10 are high, ensuring a sufficient intake air quantity, so that it is readily possible to obtain a homogeneous air-fuel mixture even using only in-cylinder injector 110. In this manner, the fuel injected from in-cylinder injector 110 vaporizes within the combustion chamber involving latent heat of vaporization (or, absorbing heat from the combustion chamber). Thus, the temperature of the air-fuel mixture is decreased at the compression end, whereby antiknock performance is improved. Further, since the temperature within the combustion chamber is decreased, intake efficiency improves, leading to high power output.

In the map for the warm state in FIG. 3, fuel injection is also carried out using only in-cylinder injector 110 when the load factor is KL(1) or less. This shows that in-cylinder injector 110 alone is used in a predetermined low load range when the temperature of engine 10 is high. When engine 10 is in the warm state, deposits are likely to accumulate in the injection hole of in-cylinder injector 110. However, when fuel injection is carried out using in-cylinder injector 110, the temperature of the injection hole can be lowered, whereby accumulation of deposits is prevented. Further, clogging of in-cylinder injector 110 may be prevented while ensuring the minimum fuel injection quantity thereof Thus, in-cylinder injector 110 alone is used in the relevant range.

When comparing FIG. 3 and FIG. 4, there is a range of "DI RATIO r=0%" only in the map for the cold state in FIG. 4. This shows that fuel injection is carried out using only intake manifold injector 120 in a predetermined low load range (KL(3) or less) when the temperature of engine 10 is low. When engine 10 is cold and low in load and the intake air quantity is small, atomization of the fuel is unlikely to occur. In such a range, it is difficult to ensure favorable combustion with the fuel injection from in-cylinder injector 110. Further, particularly in the low-load and low-speed range, high output using in-cylinder injector 110 is unnecessary. Accordingly, fuel injection is carried out using only intake manifold injector 120, rather than in-cylinder injector 110, in the relevant range.

Further, in an operation other than the normal operation, or, in the catalyst warm-up state during idling of engine 10 (abnormal operation state), in-cylinder injector 110 is controlled to carry out stratified charge combustion. By causing the stratified charge combustion during the catalyst warm-up operation, warming up of the catalyst is promoted, and exhaust emission is thus improved.

Engine (2) to Which Present Control Apparatus is Suitably Applied

Hereinafter, an engine (2) to which the control apparatus of the present embodiment is suitably applied will be described. In the following description of the engine (2), the configurations similar to those of the engine (1) will not be repeated.

Figure 5:
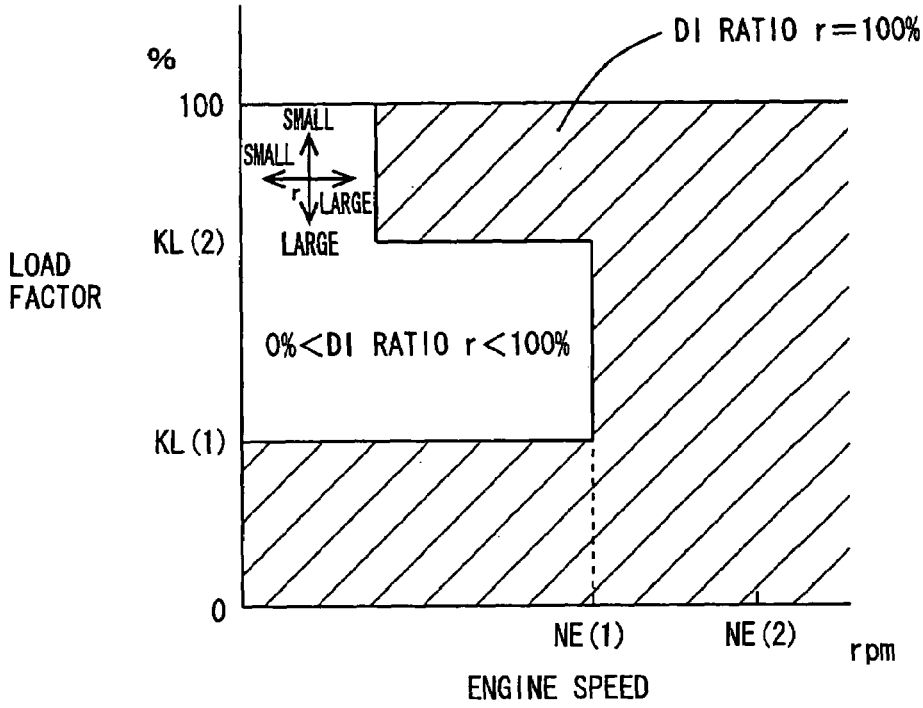
FIG. 5 shows a DI ratio map for a warm state (2) of an engine to which the present control apparatus is suitably applied.
Figure 6:
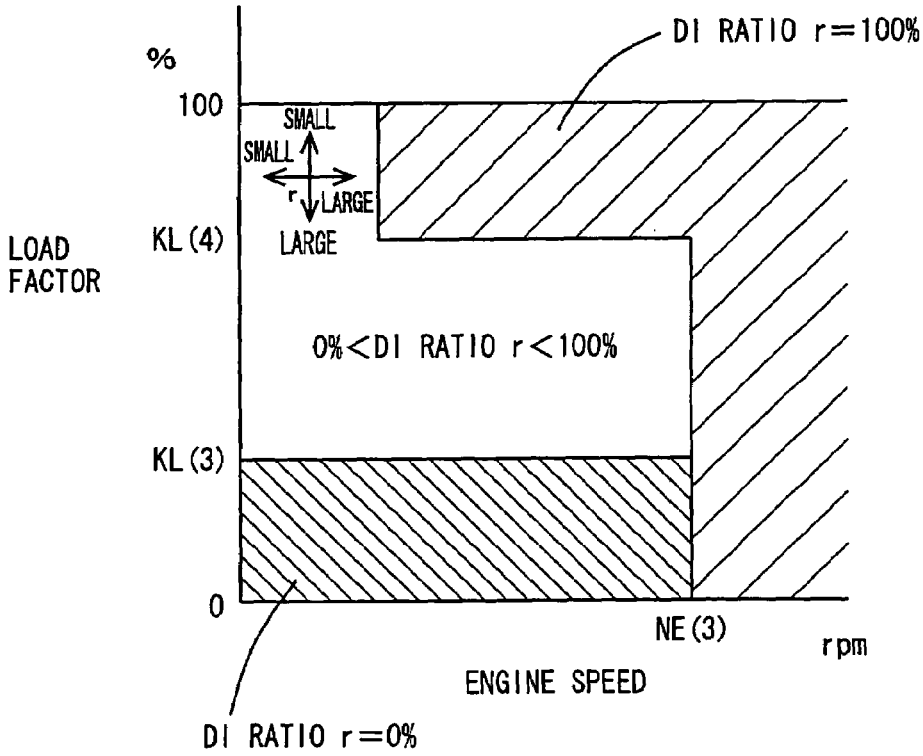
FIG. 6 shows a DI ratio map for a cold state (2) of an engine to which the present control apparatus is suitably applied.

Referring to FIGS. 5 and 6, maps each indicating the fuel injection ratio between in-cylinder injector 110 and intake manifold injector 120, identified as information associated with the operation state of engine 10, will be described. The maps are stored in ROM 320 of engine ECU 300. FIG. 5 is the map for the warm state of engine 10, and FIG. 6 is the map for the cold state of engine 10.

FIGS. 5 and 6 differ from FIGS. 3 and 4 in the following points. "DI RATIO r=100%" holds in the range where the engine speed of the engine is equal to or higher than NE(1) in the map for the warm state, and in the range where the engine speed is NE(3) or higher in the map for the cold state. Further, except for the low-speed range, "DI RATIO r=100%" holds in the range where the load factor is KL(2) or greater in the map for the warm state, and in the range where the load factor is KL(4) or greater in the map for the cold state. This means that fuel injection is carried out using only in-cylinder injector 110 in the range where the engine speed is at a predetermined high level, and that fuel injection is often carried out using only in-cylinder injector 110 in the range where the engine load is at a predetermined high level. However, in the low-speed and high-load range, mixing of an air-fuel mixture formed by the fuel injected from in-cylinder injector 110 is poor, and such inhomogeneous air-fuel mixture within the combustion chamber may lead to unstable combustion. Thus, the fuel injection ratio of in-cylinder injector 110 is increased as the engine speed increases where such a problem is unlikely to occur, whereas the fuel injection ratio of in-cylinder injector 110 is decreased as the engine load increases where such a problem is likely to occur. These changes in the fuel injection ratio of in-cylinder injector 110, or, the DI ratio r, are shown by crisscross arrows in FIGS. 5 and 6. In this manner, variation in output torque of the engine attributable to the unstable combustion can be suppressed. It is noted that these measures are approximately equivalent to the measures to decrease the fuel injection ratio of in-cylinder injector 110 as the state of the engine moves toward the predetermined low speed range, or to increase the fuel injection ratio of in-cylinder injector 110 as the engine state moves toward the predetermined low load range. Further, except for the relevant range (indicated by the crisscross arrows in FIGS. 5 and 6), in the range where fuel injection is carried out using only in-cylinder injector 110 (on the high speed side and on the low load side), a homogeneous air-fuel mixture is readily obtained even when the fuel injection is carried out using only in-cylinder injector 110. In this case, the fuel injected from in-cylinder injector 110 vaporizes within the combustion chamber involving latent heat of vaporization (by absorbing heat from the combustion chamber). Accordingly, the temperature of the air-fuel mixture is decreased at the compression side, and thus, the antiknock performance improves. Further, with the temperature of the combustion chamber decreased, intake efficiency improves, leading to high power output.

In engine 10 explained in conjunction with FIGS. 3-6, homogeneous combustion is achieved by setting the fuel injection timing of in-cylinder injector 110 in the intake stroke, while stratified charge combustion is realized by setting it in the compression stroke. That is, when the fuel injection timing of in-cylinder injector 110 is set in the compression stroke, a rich air-fuel mixture can be located locally around the spark plug, so that a lean air-fuel mixture in the combustion chamber as a whole is ignited to realize the stratified charge combustion. Even if the fuel injection timing of in-cylinder injector 110 is set in the intake stroke, stratified charge combustion can be realized if it is possible to provide a rich air-fuel mixture locally around the spark plug.

As used herein, the stratified charge combustion includes both the stratified charge combustion and semi-stratified charge combustion. In the semi-stratified charge combustion, intake manifold injector 120 injects fuel in the intake stroke to generate a lean and homogeneous air-fuel mixture in the whole combustion chamber, and then in-cylinder injector 110 injects fuel in the compression stroke to generate a rich air-fuel mixture around the spark plug, so as to improve the combustion state. Such semi-stratified charge combustion is preferable in the catalyst warm-up operation for the following reasons. In the catalyst warm-up operation, it is necessary to considerably retard the ignition timing and maintain a favorable combustion state (idling state) so as to cause a high-temperature combustion gas to reach the catalyst. Further, a certain quantity of fuel needs to be supplied. If the stratified charge combustion is employed to satisfy these requirements, the quantity of the fuel will be insufficient. If the homogeneous combustion is employed, the retarded amount for the purpose of maintaining favorable combustion is small compared to the case of stratified charge combustion. For these reasons, the above-described semi-stratified charge combustion is preferably employed in the catalyst warm-up operation, although either of stratified charge combustion and semi-stratified charge combustion may be employed.

Further, in the engine explained in conjunction with FIGS. 3-6, the fuel injection timing of in-cylinder injector 110 is set in the intake stroke in a basic range corresponding to the almost entire range (here, the basic range refers to the range other than the range where semi-stratified charge combustion is carried out with fuel injection from intake manifold injector 120 in the intake stroke and fuel injection from in-cylinder injector 110 in the compression stroke, which is carried out only in the catalyst warm-up state). The fuel injection timing of in-cylinder injector 110, however, may be set temporarily in the compression stroke for the purpose of stabilizing combustion, for the following reasons.

When the fuel injection timing of in-cylinder injector 110 is set in the compression stroke, the air-fuel mixture is cooled by the injected fuel while the temperature in the cylinder is relatively high. This improves the cooling effect and, hence, the antiknock performance. Further, when the fuel injection timing of in-cylinder injector 110 is set in the compression stroke, the time from the fuel injection to the ignition is short, which ensures strong penetration of the injected fuel, so that the combustion rate increases. The improvement in antiknock performance and the increase in combustion rate can prevent variation in combustion, and thus, combustion stability is improved.

Furthermore, irrespectively of the engine 10 temperature (i.e., in either a warm state or a cold state) when idling is off (i.e., an idle switch is off, the accelerator pedal is pressed) the FIG. 3 or 5 map for a warm state may be used. (Regardless of cold or warm state, in-cylinder injector 110 is used for a low load range.)

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A control apparatus for an internal combustion engine having a first fuel injection mechanism injecting fuel into a cylinder and a second fuel injection mechanism injecting the fuel into an intake manifold, comprising:

a first controller controlling said internal combustion engine in a warm state so that only said first fuel injection mechanism injects the fuel to start said internal combustion engine; and a second controller controlling said internal combustion engine in a cold state so that only said second fuel injection mechanism injects the fuel to start said internal combustion engine, wherein said first fuel injection mechanism is an in-cylinder injector and said second fuel injection mechanism is an intake manifold injector, wherein the first controller controls a first fuel injection profile to the internal combustion engine that is in the warm state, wherein the second controller controls a second fuel injection profile to the internal combustion engine that is in the cold state, and wherein the first and second fuel injection profiles each determine a ratio of fuel that is injected by the in-cylinder injector to fuel that is injected by the intake manifold injector, and where the first and second fuel injection profiles are defined by at least one of an engine speed and an engine load.

2. The control apparatus according to claim 1, wherein the first and second injection profiles are each defined by at least the engine speed and the engine load.

3. The control apparatus according to claim 2, wherein the first injection profile may be characterized in that it determines a high fuel injection ratio of fuel that is injected by the in-cylinder injector to fuel that is injected by the intake manifold injector at low engine speeds and low engine load, a high fuel injection ratio of fuel that is injected by the in-cylinder injector to fuel that is injected by the intake manifold injector at high engine speeds and high engine loads, and an intermediate fuel ratio of fuel that is injected by the in-cylinder injector to fuel that is injected by the intake manifold injector at low engine speeds and at intermediate engine loads.

4. The control apparatus according to claim 2, wherein the second injection profile may be characterized in that it determines a low fuel injection ratio of fuel that is injected by the in-cylinder injector to fuel that is injected by the intake manifold injector at low engine speeds and low engine loads, and a high fuel injection ratio of fuel that is injected by the in-cylinder injector to fuel that is injected by the intake manifold injector at high engine speeds and high engine loads.

5. A control apparatus for an internal combustion engine having first fuel injection means for injecting fuel into a cylinder and second fuel injection means for injecting the fuel into an intake manifold, comprising:

first controlling means for controlling said internal combustion engine in a warm state so that only said first fuel injection means injects the fuel to start said internal combustion engine; and second controlling means for controlling said internal combustion engine in a cold state so that only said second fuel injection means injects the fuel to start said internal combustion engine, wherein said first fuel injection means is an in-cylinder injector and said second fuel injection means is an intake manifold injector, wherein the first controlling means controls a first fuel injection profile to the internal combustion engine that is in the warm state, wherein the second controlling means controls a second fuel injection profile to the internal combustion engine that is in the cold state, and wherein the first and second fuel injection profiles each determine a ratio of fuel that is injected by the in-cylinder injector to fuel that is injected by the intake manifold injector, and where the first and second fuel injection profiles are each defined by at least one of an engine speed and an engine load.

6. The control apparatus according to claim 5, wherein the first and second injection profiles are each defined by at least the engine speed and the engine load.

7. The control apparatus according to claim 6, wherein the first injection profile may be characterized in that it determines a high fuel injection ratio of fuel that is injected by the in-cylinder injector to fuel that is injected by the intake manifold injector at low engine speeds and low engine load, a high fuel injection ratio of fuel that is injected by the in-cylinder injector to fuel that is injected by the intake manifold injector at high engine speeds and high engine loads, and an intermediate fuel ratio of fuel that is injected by the in-cylinder injector to fuel that is injected by the intake manifold injector at low engine speeds and at intermediate engine loads.

8. The control apparatus according to claim 6, wherein the second injection profile may be characterized in that it determines a low fuel injection ratio of fuel that is injected by the in-cylinder injector to fuel that is injected by the intake manifold injector at low engine speeds and low engine loads, and a high fuel injection ratio of fuel that is injected by the in-cylinder injector to fuel that is injected by the intake manifold injector at high engine speeds and high engine loads.

* * * * *